US009195188B2

(12) United States Patent
Gon

(10) Patent No.: US 9,195,188 B2
(45) Date of Patent: Nov. 24, 2015

(54) FIXING DEVICE AND IMAGE FORMING APPARATUS PROVIDED THEREWITH

(71) Applicant: KYOCERA Document Solutions Inc., Osaka (JP)

(72) Inventor: Shoko Gon, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/647,040

(22) PCT Filed: Apr. 25, 2014

(86) PCT No.: PCT/JP2014/061670
§ 371 (c)(1),
(2) Date: May 22, 2015

(87) PCT Pub. No.: WO2014/208190
PCT Pub. Date: Dec. 31, 2014

(65) Prior Publication Data

US 2015/0309457 A1 Oct. 29, 2015

(30) Foreign Application Priority Data

Jun. 28, 2013 (JP) ..... 2013-136593

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2085
USPC ..... 399/329
See application file for complete search history.

(56) References Cited

U.S. PATENT DOCUMENTS

| | | | | |
|---|---|---|---|---|
| 7,130,572 | B2 * | 10/2006 | Kubochi | G03G 15/2053 399/328 |
| 7,283,780 | B2 * | 10/2007 | Uchida | G03G 15/2053 399/329 |
| 2006/0054467 | A1 * | 3/2006 | Oishi | G03G 15/2053 198/835 |
| 2007/0242990 | A1 * | 10/2007 | Ohhara | G03G 15/2064 399/329 |
| 2008/0240807 | A1 * | 10/2008 | Lee | G03G 15/2064 399/329 |
| 2010/0129124 | A1 | 5/2010 | Hara | 399/333 |

(Continued)

FOREIGN PATENT DOCUMENTS

| | | | |
|---|---|---|---|
| JP | 9-171310 | A | 6/1997 |
| JP | 2004-205538 | A | 7/2004 |
| JP | 2010-122489 | A | 6/2010 |

(Continued)

OTHER PUBLICATIONS

International Search report dated Jun. 24, 2014, issued to the corresponding International Application No. PCT/JP2014/061670.

*Primary Examiner* — Susan Lee
(74) *Attorney, Agent, or Firm* — Stein IP, LLC

(57) ABSTRACT

A fixing device is provided with a fixing belt, a fixing roller inserted inside the fixing belt, a pressure roller that is pressed against the fixing belt, a coil that generates magnetic flux for induction heating of the fixing belt, and a belt regulating plate that is disposed at a side of an end surface of the fixing roller in a predetermined direction and regulates movement of the fixing belt in the predetermined direction. The belt regulating plate has a multi-layer structure including a resin plate disposed at a fixing belt side and a nonmagnetic metal plate disposed at a side opposite to the fixing belt side.

7 Claims, 10 Drawing Sheets

(56) References Cited

U.S. PATENT DOCUMENTS

| | | | | |
|---|---|---|---|---|
| 2012/0093547 | A1 | 4/2012 | Baba et al. | 399/329 |
| 2013/0064581 | A1 * | 3/2013 | Okamoto | G03G 15/1615 399/302 |

FOREIGN PATENT DOCUMENTS

| | | | |
|---|---|---|---|
| JP | 2010-145958 | A | 7/2010 |
| JP | 2012-83667 | A | 4/2012 |

* cited by examiner

FIXING DEVICE AND IMAGE FORMING APPARATUS PROVIDED THEREWITH

CROSS-REFERENCE TO RELATED APPLICATIONS

This application is national stage of International Application No. PCT/JP2014/061670, filed Apr. 25, 2014, which claims the benefit of priority to Japanese Application No. 2013-136593, filed Jun. 28, 2013, in the Japanese Patent Office, the disclosures of which are incorporated herein by reference.

TECHNICAL FIELD

The present invention relates to a fixing device that fixes a toner image on a sheet, and an image forming apparatus provided therewith.

BACKGROUND ART

Conventionally, there have been known fixing devices adopting an induction heating method, which are incorporated, for example, in image forming apparatuses such as printers (see, for example, Patent Literature 1). Fixing devices adopting the induction heating method include, for example, a fixing belt that is formed in an endless shape and has an induction heating layer, a fixing roller that is inserted inside the fixing belt and rotates with the fixing belt, a pressure roller that is pressed against the fixing belt such that a fixing nip is formed between the fixing belt and the pressure roller, and the like. Furthermore, a coil that generates magnetic flux for induction heating by which the fixing belt is heated is disposed at an interval from the fixing belt.

CITATION LIST

Patent Literature

Patent Literature 1 JP-A-2012-83667

SUMMARY OF INVENTION

Technical Problem

In fixing devices adopting the induction heating method, a coil 301 as shown in FIG. 10 and FIG. 11 is used, for example. The coil 301 is wound in a loop shape elongated in a belt width direction of the fixing belt 302 (a rotation shaft direction of a fixing roller 303) so as to extend over from one end portion to the other end portion of the fixing belt 302 in the belt width direction of the fixing belt 302 (the rotation shaft direction of the fixing roller 303). The coil 301 is disposed at a side of the fixing belt 302 opposite to a pressure roller 304 side of the fixing belt 302 where the pressure roller 304 is pressed against the fixing belt 302. However, in a case where the coil 301 as shown in FIG. 10 and FIG. 11 is used, there arises an inconvenience that temperature is lower in the vicinity of the end portions than in the vicinity of a center portion of the fixing belt 302 in the belt width direction thereof.

Specifically, as shown in FIG. 12, at each end portion of the fixing belt 302 in the belt width direction thereof, magnetic flux generated at each of straight-line portions 301*a* (illustrated in FIG. 11 as well) and substantially U-shaped bent portions 301*b* (illustrated in FIG. 11 as well) of the coil 301 contributes to heating of the fixing belt 302. Here, in FIG. 12, the magnetic flux generated at the straight-line portions 301*a* of the coil 301 is indicated by dotted arrows, and the magnetic flux generated at the bent portions 301*b* of the coil 301 is indicated by solid arrows. The magnetic flux generated at the straight-line portions 301*a* of the coil 301, even if the magnetic flux direction changes periodically, irrespective of the magnetic flux direction, enters the fixing belt 302 from an outer peripheral surface side of the fixing belt 302. On the other hand, if the magnetic flux direction changes periodically, the magnetic flux generated at the bent portions 301*b* of the coil 301, depending on the magnetic flux direction, enters the fixing belt 302 from the outer peripheral surface side of the fixing belt 302 or enters the fixing belt 302 from an inner peripheral surface side of the fixing belt 302 via each end surface of the fixing roller 303 in its rotation shaft direction.

Here, an electric current direction of an eddy current generated by the magnetic flux that has entered the fixing belt 302 from the outer peripheral surface side of the fixing belt 302 is opposite to an electric current direction of an eddy current generated by the magnetic flux that has entered the fixing belt 302 from the inner peripheral surface side of the fixing belt 302.

Thus, in a case where a thickness of the induction heating layer of the fixing belt 302 is smaller than a magnetic field penetration depth, when the magnetic flux generated at the bent portions 301*b* of the coil 301 has entered the fixing belt 302 from the inner peripheral surface side of the fixing belt 302, the eddy current generated by the magnetic flux that has entered the fixing belt 302 from the inner peripheral surface side of the fixing belt 302 interferes with the eddy current generated by the magnetic flux that has entered the fixing belt 302 from the outer peripheral surface side of the fixing belt 302 (the eddy current generated by the magnetic flux generated at the straight-line portions 301*a* of the coil 301), and the two eddy currents cancel each other in the vicinity of a center portion of the fixing belt 302 in a thickness direction thereof. This results in reduction of heat generation in the vicinity of the center portion of the fixing belt 302 in the thickness direction thereof. As a result, in the vicinity of each end portion of the fixing belt 302 in the belt width direction thereof, in comparison with in the vicinity of the center portion of the fixing belt 302 in the belt width direction thereof, an amount of heat generation per unit area is reduced. That is, temperature of the fixing belt 302 becomes lower in the vicinity of each end portion of the fixing belt 302 in the belt width direction thereof than in the vicinity of the center portion of the fixing belt 302 in the belt width direction thereof.

Here, in a case where the thickness of the induction heating layer of the fixing belt 302 is sufficiently greater than the magnetic field penetration depth (for example, the thickness of the induction heating layer is greater than twice the magnetic field penetration depth), when the magnetic flux generated at the bent portions 301*b* of the coil 301 has entered the fixing belt 302 from the inner peripheral surface side of the fixing belt 302, the eddy current generated by the magnetic flux that has entered the fixing belt 302 from the inner peripheral surface side thereof hardly interferes with the eddy current generated by the magnetic flux that has entered the fixing belt 302 from the outer peripheral surface side thereof (the eddy current generated by the magnetic flux generated at the straight-line portions 301*a* of the coil 301). Thus, by forming the induction heating layer of the fixing belt 302 to have a thickness sufficiently greater than the magnetic field penetration depth, it is possible to reduce reduction of the heat generation in the vicinity of each end portion of the fixing belt 302 in the belt width direction thereof.

However, if the thickness of the fixing belt 302 is increased, the fixing belt 302 becomes less flexible. With less flexibility, the fixing belt 302 yields less at the portion thereof where it is pressed against the pressure roller 304, and this can be assumed to lead to another inconvenience that a sufficient nip width of a fixing nip 300N cannot be obtained.

With the configuration shown in FIG. 10 to FIG. 12, the magnetic flux generated at the bent portions 301*b* of the coil 301 concentrates on an edge of each end portion of the fixing belt 302 in the belt width direction thereof, which results in increased heat generation at the edge of each end portion of the fixing belt 302. In this case, if the thickness of the fixing belt 302 is small, thermal conduction in the belt width direction thereof is accordingly low, and thus heat generated at the edge of each end portion of the fixing belt 302 is difficult to be transferred in the belt width direction thereof. As a result, there arises an inconvenience that temperature rises excessively at the edge of each end portion of the fixing belt 302.

The present invention has been made to solve the above problems, and an object of the present invention is to provide a fixing device configured to heat a fixing belt by using the induction heating method and capable of not only reducing temperature decline at end portions of a fixing belt in a belt width direction thereof but also preventing excessive rise of temperature at an edge of the fixing belt, and an image forming apparatus provided with such a fixing device.

Solution to Problem

In order to achieve the above object, according to one aspect of the present invention, a fixing device is provided with a fixing belt that is formed in an endless shape and has an induction heating layer, a fixing roller that is inserted inside the fixing belt, that is rotatably supported with a shaft extending in a predetermined direction as a rotation shaft thereof, and that is configured to rotate with the fixing belt, a pressure roller that is pressed against the fixing belt and configured to rotate to thereby cause the fixing belt and the fixing roller to perform driven-rotation, a coil that is disposed at an interval from the fixing belt, at a side of the fixing belt opposite from the pressure roller, that is wound in a loop shape elongated in the predetermined direction so as to extend over from one end portion to another end portion of the fixing belt in the predetermined direction, and that is configured to generate magnetic flux for induction heating by which the fixing belt is heated, and a belt regulating plate that is disposed at a side of an end surface of the fixing roller in the predetermined direction such that the belt regulating plate comes into contact with the fixing belt when the fixing belt moves in the predetermined direction to thereby regulate movement of the fixing belt in the predetermined direction. Here, the belt regulating plate has a multi-layer structure including a resin layer disposed on a side of the belt regulating plate close to the fixing belt and a nonmagnetic metal layer disposed on a side of the belt regulating plate away from the fixing belt.

According to the present invention, since the portion of the belt regulating plate on the side thereof away from the fixing belt is constituted of the nonmagnetic metal layer, magnetic flux directed toward an inner peripheral surface of the fixing belt via an end surface of the fixing roller in the predetermined direction is blocked by the nonmagnetic metal layer, and an amount of magnetic flux that enters the fixing belt from the inner peripheral surface side of the fixing belt is reduced. This helps reduce occurrence of a phenomenon in which, in the vicinity of the end portion of the fixing belt in a belt width direction thereof (the predetermined direction), an eddy current generated by magnetic flux that has entered the fixing belt from an outer peripheral surface side of the fixing belt and an eddy current generated by magnetic flux that has entered the fixing belt from an inner peripheral surface side of the fixing belt interfere with each other, so that the two eddy currents cancel each other (a reduced amount of eddy current is converted to heat). Thus, it is possible to reduce decline of temperature of a portion of the fixing belt in the vicinity of each end portion thereof to lower than temperature of a portion of the fixing belt in the vicinity of a center portion thereof in the belt width direction (the predetermined direction).

Furthermore, with the belt regulating plate including the nonmagnetic metal layer provided at the side of the end surface of the fixing roller in the belt width direction thereof, an edge of the end portion of the fixing belt in the belt width direction thereof is shielded by the nonmagnetic metal layer, and this helps reduce concentration of magnetic flux on the edge of the fixing belt. This helps prevent excessive rise of temperature from occurring at the edge of the fixing belt.

A belt portion of the fixing belt that has come to a fixing nip (that is, a belt portion of the fixing belt that is being pressed against the pressure roller) yields by being pressed against the pressure roller, and then, after leaving the fixing nip, the belt portion is released from the state of being pressed against the pressure roller, and recovered. That is, the fixing belt rotates while being partially displaced in a diameter direction thereof. Thus, if the fixing belt is displaced in the belt width direction thereof (the predetermined direction) into contact with the belt regulating plate, even if the fixing belt rotates together with the belt regulating plate, the fixing belt behaves in a fashion that it rubs itself against the belt regulating plate in the vicinity of the fixing nip. As a result, stress is applied to the fixing belt.

According to the present invention, however, although the portion of the belt regulating plate on the side thereof away from the fixing belt is constituted of the nonmagnetic metal layer, the portion of the belt regulating plate on the side thereof close to the fixing belt is constituted of the resin layer. Thus, it is the resin layer that the fixing belt comes into contact with when it is displaced in the belt width direction thereof (the predetermined direction). As a result, even if the fixing belt behaves in a fashion that it rubs itself against the belt regulating plate, since the fixing belt is in contact with the resin layer that allows the fixing belt to slide smoothly thereon, the stress applied to the fixing belt is reduced. This helps alleviate deformation and deterioration of the fixing belt.

Advantageous Effects of Invention

According to the present invention, it is possible to reduce decline of temperature occurring at an end portion of a fixing belt in a belt width direction thereof and to prevent excessive rise of temperature from occurring at an edge of the end portion of the fixing belt in the belt width direction.

DESCRIPTION OF EMBODIMENTS

Hereinafter, descriptions will be given of a fixing device according to one embodiment of the present invention and an image forming apparatus provided with the same by taking a monochrome multifunction peripheral as an example.

Figure 1:
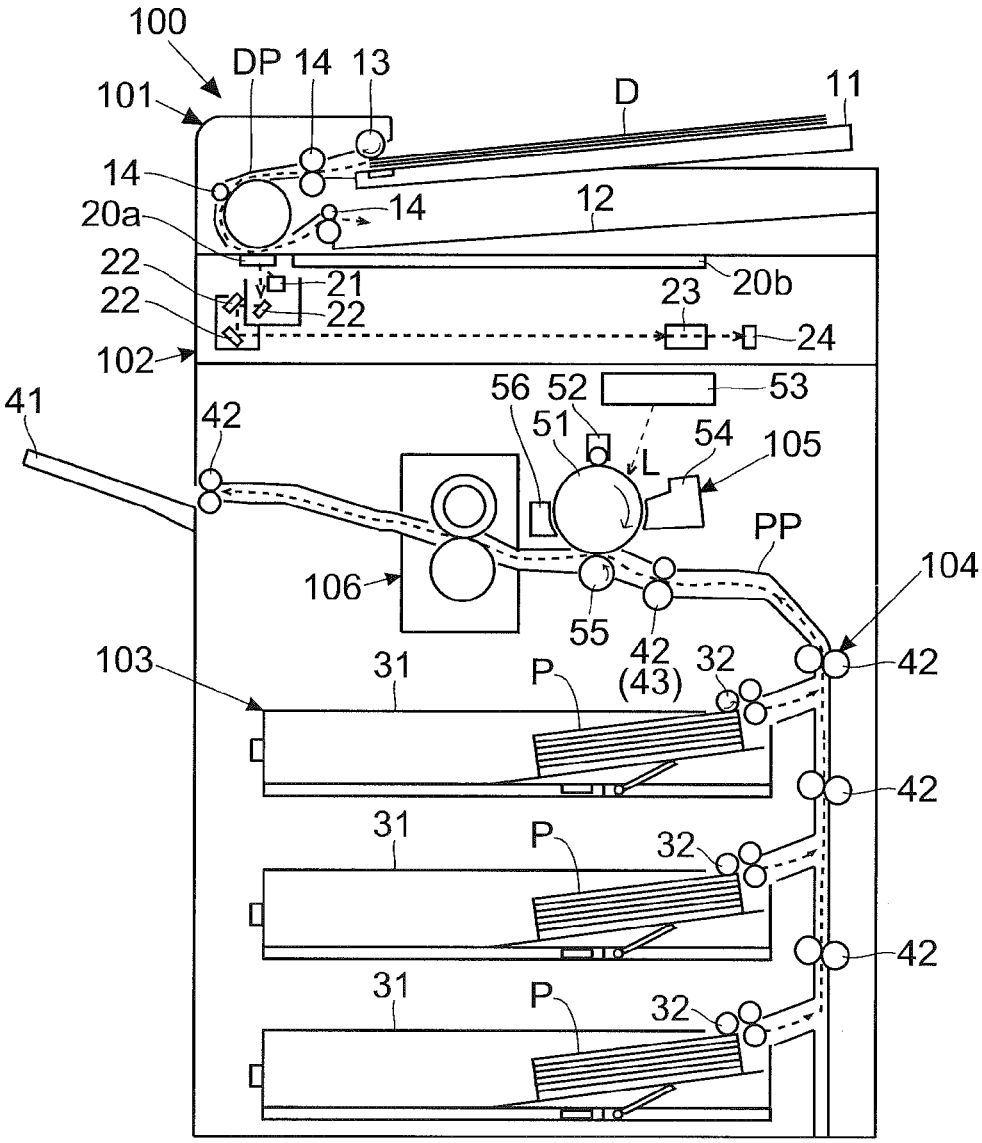
FIG. 1 is a schematic diagram of an image forming apparatus according to one embodiment of the present invention.

As shown in a FIG. 1, an image forming apparatus 100 is provided with a document conveying portion 101, an image reading portion 102, a sheet feeding portion 103, a sheet conveying portion 104, an image forming portion 105, and a fixing portion 106.

In the document conveying portion 101, a document D set on a document feeding tray 11 is fed into a document conveying path DP, conveyed to a conveying reading position, and then delivered onto a delivery tray 12. The document conveying portion 101 is provided with a document feeding roller 13 for feeding the document D into the document conveying path DP, and a plurality of conveying roller pairs 14 for conveying the document D along the document conveying path DP.

The image reading portion 102 reads a document D conveyed onto a contact glass 20*a* (the conveying reading position) for reading a document D conveyed thereto or a document D placed on a contact glass 20*b* for reading a document D placed thereon, and generates image data of whichever document D it has read. The image reading portion 102 is provided with a reading mechanism constituted of a lamp 21, mirrors 22, a lens 23, a line sensor 24, and the like.

The sheet feeding portion 103 has a sheet cassette 31 where sheets P are stored, and feeds the sheets P stored in the sheet cassette 31 into a sheet conveying path PP. The sheet feeding portion 103 is provided with a sheet feeding roller 32 for feeding a sheet P into the sheet conveying path PP.

The sheet conveying portion 104 conveys a sheet P fed into the sheet conveying path PP to a transfer nip and a fixing nip, in this order, and delivers the sheet P to a delivery tray 41. The sheet conveying portion 104 is provided with a plurality of conveying roller pairs 42 for conveying a sheet P along the sheet conveying path PP. One conveying roller pair 42, among the plurality of conveying roller pairs 42, serves as a registration roller pair 43. The registration roller pair 43 makes the sheet P stand by before the transfer nip, until the registration roller pair 43 sends out the sheet P toward the transfer nip with timing coordinated with formation of a toner image performed by the image forming portion 105.

The image forming portion 105 forms a toner image based on image data (for example, image data obtained through reading by the image reading portion 102), and transfers the toner image onto the sheet P. The image forming portion 105 includes a photosensitive drum 51, a charging device 52, an exposure device 53, a developing device 54, a transfer roller 55, and a cleaning device 56.

In image formation, the photosensitive drum 51 rotates, during which period the charging device 52 electrically charges a surface of the photosensitive drum 51 to a predetermined potential. The exposure device 53 has a light emitting element (not shown) that emits light L for exposure, and the exposure device 53 performs scanning exposure on the surface of the photosensitive drum 51, while turning on/off the light emitting element according to the image data. In this way, an electrostatic latent image is formed on the surface of the photosensitive drum 51. The developing device 54 supplies toner to the electrostatic latent image formed on the surface of the photosensitive drum 51 and thereby develops the electrostatic latent image.

The transfer roller 55 is pressed against the surface of the photosensitive drum 51, such that the transfer nip is formed between the photosensitive drums 51 and the transfer roller 55. In this state, the registration roller pair 43 forces the sheet P to enter the transfer nip, with a proper timing. At this time, a transfer voltage is applied to the transfer roller 55. Thereby, the toner image on the surface of the photosensitive drum 51 is transferred onto the sheet P. After the toner image is transferred onto the sheet P, the cleaning device 56 removes the toner and the like remaining on the surface of the photosensitive drum 51.

The fixing portion 106 applies heat and pressure to the sheet P onto which the toner image has been transferred, and thereby fixes the toner image on the sheet P. Note that the fixing portion 106 adopts an induction heating method, and the fixing portion 106 is equivalent to the "fixing device" of the present invention.

Figure 2:
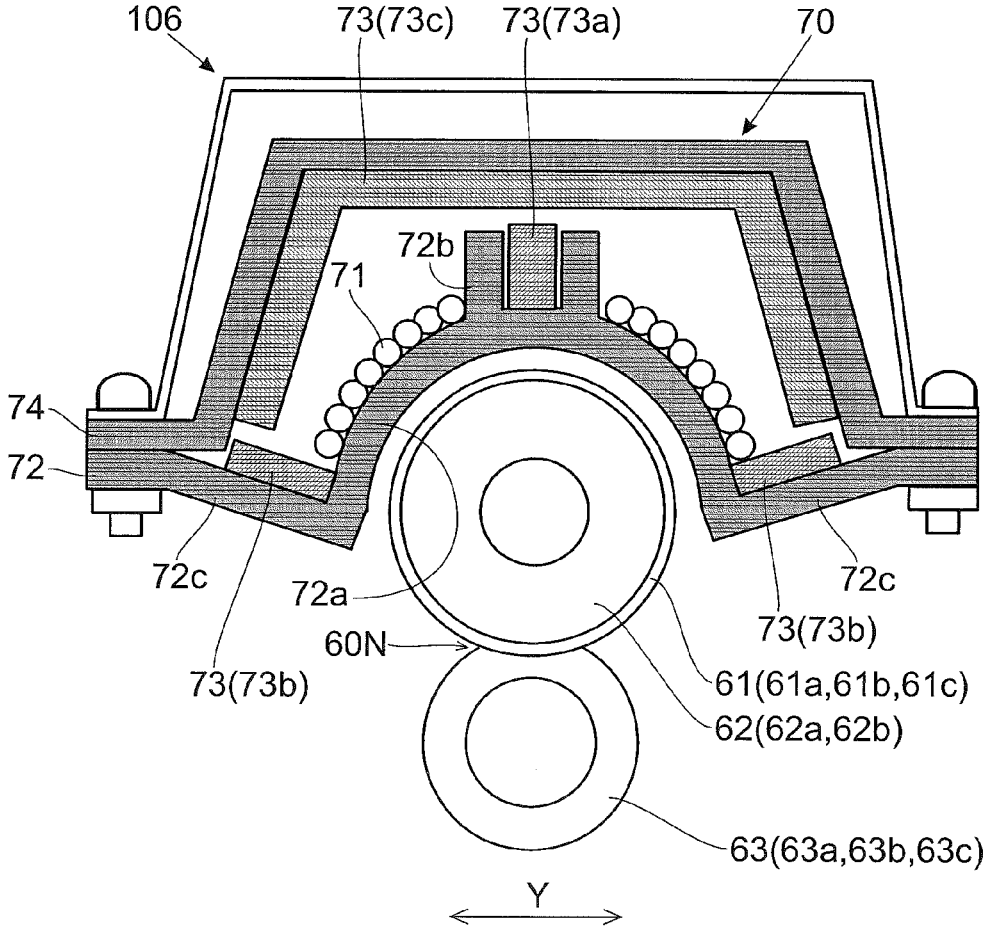
FIG. 2 is a schematic diagram of a fixing portion (a fixing device) of the image forming apparatus according to the one embodiment of the present invention.

As shown in FIG. 2, the fixing portion 106 is provided with a fixing belt 61, a fixing roller 62, a pressure roller 63, and an induction-heating unit 70. In the following descriptions, a rotation shaft direction of the fixing roller 62 and the pressure roller 63 (a direction perpendicular to a surface of the paper on which FIG. 2 is drawn) will be referred to as an X direction, and a direction perpendicular to the X direction will be referred to as a Y direction. In this case, the X direction is equivalent to the "predetermined direction" of the present invention.

The fixing belt 61 is an endless belt that is formed to have an inner diameter of about 40 mm. For example, the fixing belt 61 is constituted of an induction heating layer 61*a*, an elastic layer 61*b*, and a release layer 61*c* which are stacked together in this order from an inner side thereof. The induction heating layer 61*a* serves also as a belt base material, and is formed by using nickel electro-casting to have a thickness of about 30 μm to about 50 μm. The elastic layer 61*b* is formed by using, for example, a silicone rubber to have a thickness of about 200 μm to about 500 μm. The release layer 61*c* is formed by using PFA (copolymer of tetrafluoro ethylene and perfluoroalkyl vinyl ether) or the like. Here, instead of using nickel which is a magnetic metal, the base material may be one obtained by laying a nonmagnetic metal (copper, silver, or the like) on a resin belt formed of PI (polyimide) or the like.

The fixing roller 62 is rotatably supported with a shaft extending in the X direction as its rotation shaft. The fixing roller 62 is inserted inside the fixing belt 61, and rotates together with the fixing belt 61. Note that, in a state where the fixing roller 62 is inserted inside the fixing belt 61, the belt width direction of the fixing belt 61 is the X direction. The fixing roller 62 is a roller such that an elastic layer 62*b* is formed on a core metal 62*a*, and an outer diameter of the fixing roller 62 is substantially the same as an inner diameter (about 40 mm) of the fixing belt 61. The core metal 62*a* is formed by using nonmagnetic metal such as aluminum and nonmagnetic stainless steel. The elastic layer 62*b* is formed, for example, by using silicone rubber, to have a thickness of about 8 mm to about 10 mm.

The pressure roller 63 is rotatably supported with a shaft extending in the X direction as its rotation shaft, and is driven to rotate when a driving force is transferred thereto from an unillustrated motor. The pressure roller 63 is a roller such that an elastic layer 63*b* and a release layer 63*c* are formed one on the other on a core metal 63*a*, and has an outer diameter of about 30 mm to about 35 mm. The core metal 63*a* is formed by using aluminum. The elastic layer 63*b* is formed, for example, by using a silicone rubber, to have a thickness of about 2 mm to about 5 mm. The release layer 63*c* is formed of PFA or the like.

The pressure roller 63 is pressed against the fixing belt 61, and by rotating in this state, the pressure roller 63 causes the fixing belt 61 and the fixing roller 62 to perform driven-rotation. And a portion (press-contact portion) between the fixing belt 61 and the pressure rollers 63 serves as a fixing nip 60N. That is, when the sheet P on which the toner image has been transferred proceeds into the fixing nip 60N, the sheet P is then sent under heat and pressure in a rotation direction of the pressure roller 63.

Figure 3:
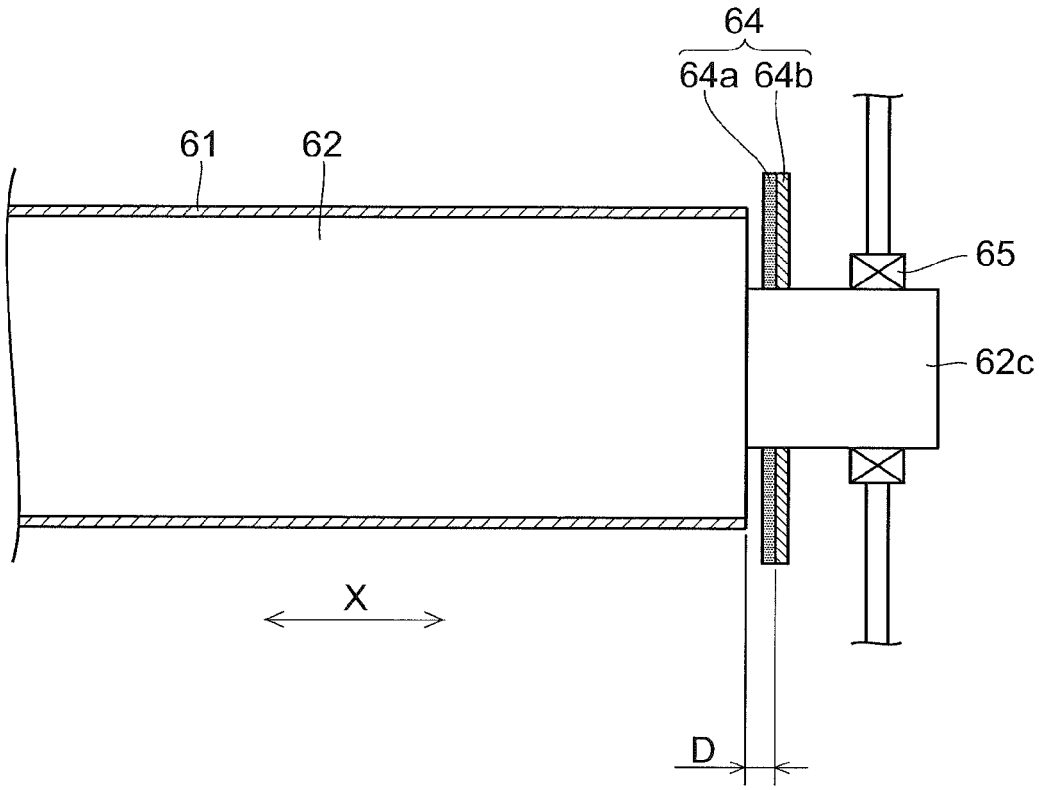
FIG. 3 is a diagram for illustrating a structure of a belt regulating plate of the fixing portion shown in FIG. 2.

Moreover, as shown in FIG. 3, at each of one end surface side and the other end surface side of the fixing roller 62 in the X direction, a disc-shaped belt regulating plate 64 is provided for regulating movement of the fixing belt 61 in the X direction. For simplicity of drawings, FIG. 3 illustrates only the belt regulating plate 64 provided at one end surface side of the fixing roller 62 in the X direction. The belt regulating plate 64 is attached to the roller shaft 62*c* of the fixing roller 62 supported by a bearing 65, and rotates together with the fixing belt 61 and the fixing roller 62. The belt regulating plate 64 has a diameter larger than the outer diameter of the fixing belt 61. Thus, if the fixing belt 61 moves in the X direction, the fixing belt 61 comes into contact with the belt regulating plate 64, and thereby the movement of the fixing belt 61 in the X direction is regulated (meandering movement of the fixing belt 61 is reduced).

The belt regulating plate 64 has a multi-layer structure (two-layer structure), including a resin plate 64*a* and a nonmagnetic metal plate 64*b* arranged in this order from the end surface side of the fixing roller 62 in the X direction. That is, the resin plate 64*a* is disposed on a side of the belt regulating plate 64 close to a fixing belt 61 (a side of the end surface of the fixing roller 62), and the nonmagnetic metal plate 64*b* is disposed on a side of the belt regulating plate 64 away from the fixing belt 61. Thus, when the fixing belt 61 moves in the X direction, the fixing belt 61 comes into contact with the resin plate 64*a*, but not with the nonmagnetic metal plate 64*b*. Here, the resin plate 64*a* is equivalent to the "resin layer" of the present invention, and the nonmagnetic metal plate 64*b* is equivalent to the "nonmagnetic metal layer" of the present invention.

The resin plate 64*a* is formed by using a heat-resistant resin, such as PEEK (polyether ether ketone), LCP (liquid crystal polymer), and PPS (polyphenylene sulfide). A thickness of the resin plate 64*a* in the X direction is set such that an interval D in the X direction between an edge of the end portion of the fixing belt 61 in the X direction (the end surface of the fixing roller 62 in the X direction) and the nonmagnetic metal plate 64*b* is about 5 mm or less. Hereinafter, the edge of the end portion of the fixing belt 61 in the X direction will be referred to simply as an edge. Here, the thickness of the resin plate 64*a* in the X direction is set more preferably such that the interval D is about 3 mm or less, and most preferably such that the interval D is about 1 mm or more and about 2 mm or less.

The nonmagnetic metal plate 64*b* is formed by using nonmagnetic metal such as aluminum, copper, and nonmagnetic stainless steel. A thickness of the nonmagnetic metal plate 64*b* in the X direction is set to be about 0.5 mm, for example. The thickness of the nonmagnetic metal plate 64*b* in the X direction may be of any value as long as it is not less than 0.1 mm. An upper limit for the thickness of the nonmagnetic metal plate 64*b* in the X direction, for which no particular limitation is set, is about 1 mm, for example. However, if there is room in space for placing the belt regulating plate 64, the thickness of the nonmagnetic metal plate 64*b* in the X direction may be greater than 1 mm for improved rigidity of the belt regulating plate 64.

Used as the belt regulating plate 64 is, for example, a member obtained by integrating the resin plate 64*a* and the nonmagnetic metal plate 64*b* with each other. In this case, the nonmagnetic metal plate 64*b* may be bonded to the resin plate 64*a*, or a constituent material of the nonmagnetic metal plate 64*b* may be vapor-deposited onto the resin plate 64*a*. Or, the resin plate 64*a* and the nonmagnetic metal plate 64*b* may be formed as different members. In this case, in attaching the belt regulating plate 64, the resin plate 64*a* and the nonmagnetic metal plate 64*b* need to be held in close contact with each other.

Figure 4:
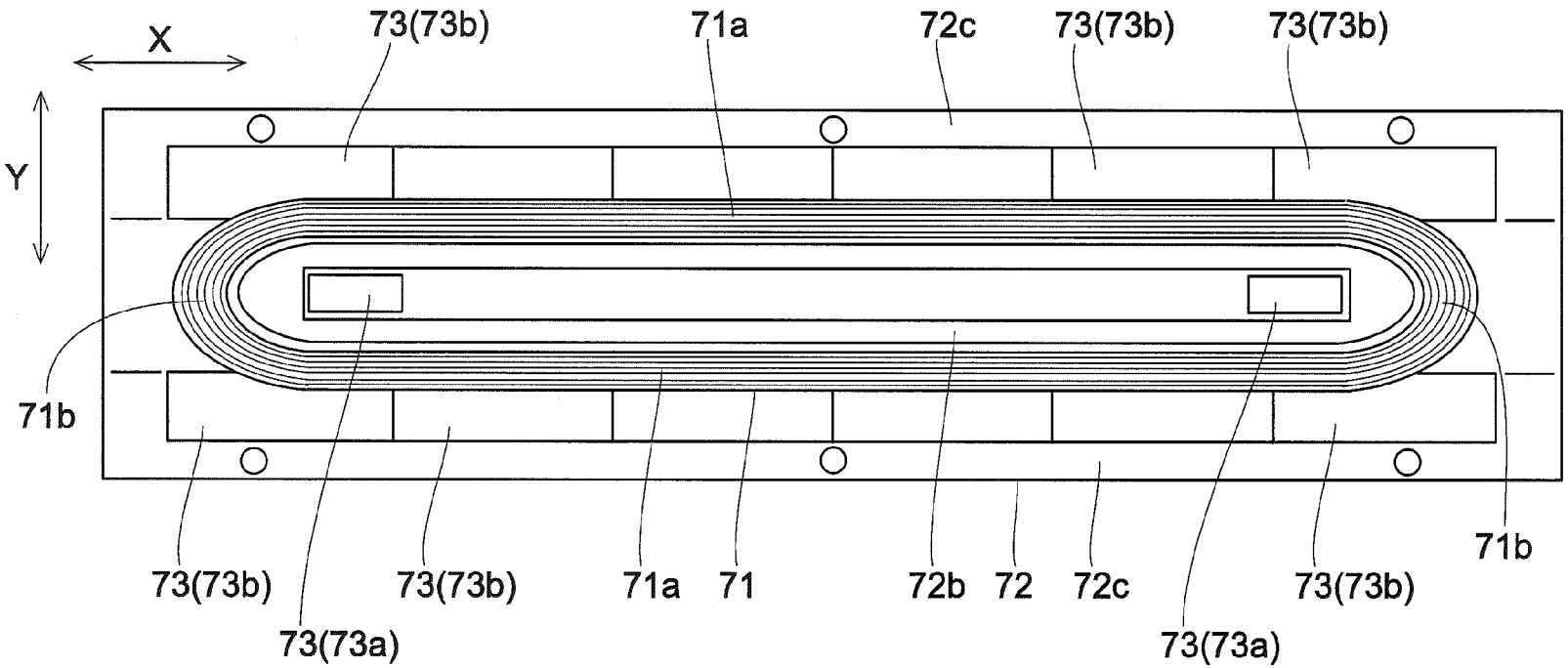
FIG. 4 is a diagram for illustrating a shape of a coil of the fixing portion shown in FIG. 2.

As shown in FIG. 2 and FIG. 4, the induction-heating unit 70 includes a coil 71 formed by twisting together a plurality of mutually-insulated enameled wires. The coil 71 is disposed at an interval from the fixing belt 61, at a side opposite from the pressure roller 63 with respect to the fixing belt 61. The coil 71 is connected to an unillustrated power supply, and by being supplied with a high frequency current from the power supply, the coil 71 generates magnetic flux for induction heating by which the fixing belt 61 (the induction heating layer 61*a*) is heated. Here, the current supplied to the coil 71 is an alternating current, and thus the direction of the magnetic flux generated from the coil 71 changes periodically.

In plan view (see FIG. 4), the coil 71 is wound in a loop shape (elliptical shape) elongated in the X direction so as to extend over from one end portion to the other end portion of the fixing belt 61 in the X direction. Furthermore, the coil 71 is formed, in sectional view (see FIG. 2), in an arc shape along a substantially half (upper half) of the fixing belt 61 so that the coil 71 is disposed at a side opposite from the pressure roller 63 with respect to the fixing belt 61. By being held by a coil bobbin 72, the coil 71 is disposed at an interval from the fixing belt 61, at the side opposite from the pressure roller 63 with respect to the fixing belt 61.

The coil bobbin 72 has an arc portion 72*a*. The arc portion 72*a* covers substantially half (upper half) of the fixing belt 61, at the side opposite from the pressure roller 63 with respect to the fixing belt 61, over from one end portion to the other end portion of the fixing belt 61 in the X direction. At a vertex portion of the arc portion 72*a*, there is provided wall portions

72*b* protruding upward so as to enclose a rectangular space a longitudinal direction of which is the X direction. At each end portion of the arc portion 72*a* in the Y direction, there is provided a flange portion 72*c* extending in a direction away from the fixing belt 61. Furthermore, the coil bobbin 72 has attached thereto a magnetic body core 73 (center cores 73*a*, side cores 73*b*, and arch cores 73*c*).

The center cores 73*a* are disposed one at each of one and the other end sides in the X direction inside the space enclosed by the wall portions 72*b* (see FIG. 4), and are bonded to the vertex portion of the arc portion 72*a* of the coil bobbin 72. The side cores 73*b* are disposed such that a plurality of side cores 73*b* are aligned in the X direction with no space therebetween on each of the pair of flange portions 72*c* of the coil bobbin 72 (see FIG. 4), and the side cores 73*b* are bonded to portions of the coil bobbin 72 where the flange portions 72*c* are connected to the arc portion 72*a* (arc portion 72*a* side portions of the flange portions 72*c*). The arch cores 73*c* are disposed so as to cover the arc portion 72*a* of the coil bobbin 72 from outside (from a side opposite to the fixing belt 61 side), and the arch cores 73*c* are bonded to an arch core holder 74 which is arch-shaped and covers the arc portion 72*a* of the coil bobbin 72 from outside. End portions of the arch core holder 74 in the Y direction are both connected to the pair of flange portions 72*c* of the coil bobbin 72, and thereby, a state is achieved in which the arch cores 73*c* are attached to the coil bobbin 72. Although not illustrated, the arch cores 73*c* are a plurality of arch cores 73*c* that are aligned in the X direction at predetermined intervals.

The coil 71 is wound so as to surround the wall portions 72*b* of the coil bobbin 72, and bonded to the arc portion 72*a* of the coil bobbin 72. Thereby, the coil 71 is held at an interval from the fixing belt 61, at the side opposite from the pressure roller 63 with respect to the fixing belt 61. When the high frequency current is supplied to the coil 71 held in this state, magnetic flux generated at the coil 71 is led by the magnetic body core 73 into the fixing belt 61. At this time, an eddy current flows in the induction heating layer 61*a* of the fixing belt 61, and Joule heat is generated in the induction heating layer 61*a* by electric resistance of the induction heating layer 61*a*, and the fixing belt 61 is heated with the Joule heat.

Figure 5:
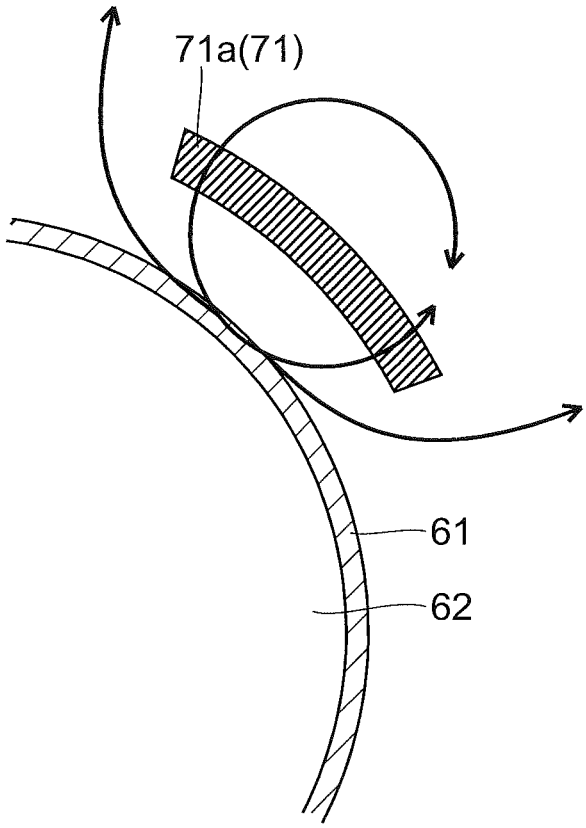
FIG. 5 is a diagram for illustrating a flow of magnetic flux in the vicinity of a central portion of the fixing portion in a belt width direction of the fixing belt (magnetic flux and magnetic flux directions are indicated by arrows)
Figure 6:
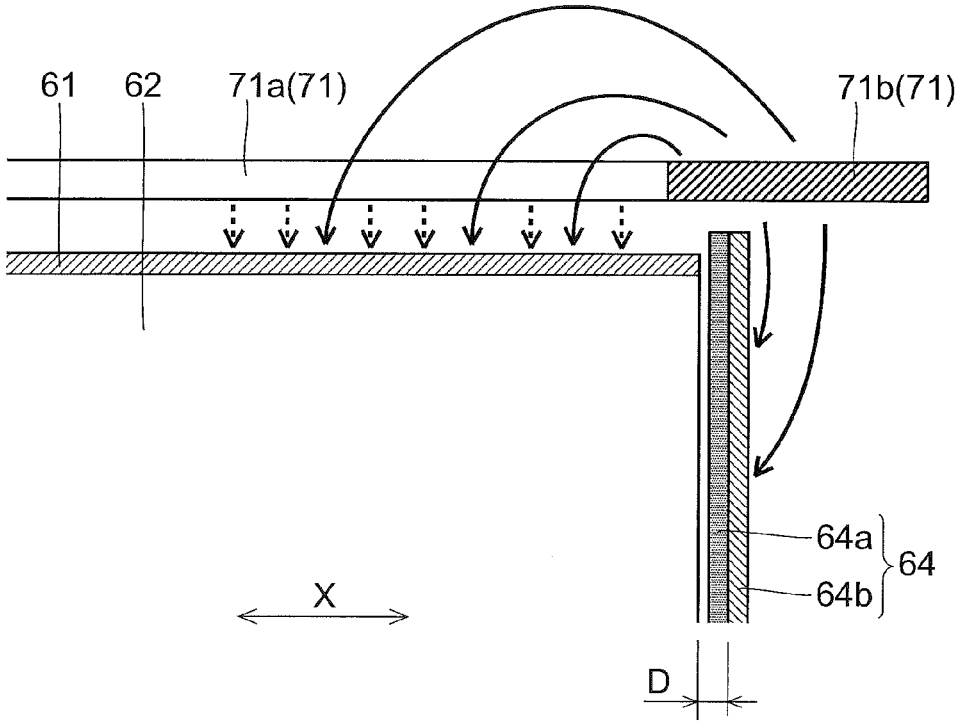
FIG. 6 is a diagram for illustrating a flow of magnetic flux in the vicinity of an end portion of the fixing portion in the belt width direction of the fixing belt (magnetic flux and magnetic flux directions are indicated by arrows)

With reference to FIG. 5 and FIG. 6, a detailed description will be given below, of a flow of magnetic flux that enters the fixing belt 61. Note that arrows in the figures schematically indicate the magnetic flux generated at the coil 71 and directions of the magnetic flux.

First, as shown in FIG. 5, in the vicinity of a center portion of the fixing belt 61 in the X direction, magnetic flux generated at straight-line portions 71*a* (illustrated in FIG. 4 as well) contributes to heating of the fixing belt 61. The magnetic flux generated at the straight-line portions 71*a* of the coil 71, even if the direction of the magnetic flux changes periodically, enters the fixing belt 61 from the outer peripheral surface side of the fixing belt 61, regardless of the magnetic flux direction, but the magnetic flux does not enter the fixing belt 61 from the inner peripheral surface side of the fixing belt 61. Thus, the eddy current generated in the induction heating layer 61*a* of the fixing belt 61 is larger closer to the outer peripheral surface of the fixing belt 61, and the amount of heat generation is also larger closer to the outer peripheral surface of the fixing belt 61.

Next, as shown in FIG. 6, in the vicinity of the end portion of the fixing belt 61 in the X direction, the magnetic flux generated at the straight-line portions 71*a* of the coil 71 and magnetic flux generated at substantially U-shaped bent portions 71*b* (illustrated in FIG. 4 as well) of the coil 71 both contribute to heating of the fixing belt 61. In FIG. 6, the magnetic flux generated at the straight-line portions 71*a* of the coil 71 is indicated by dotted arrows, while the magnetic flux generated at the bent portions 71*b* of the coil 71 is indicated by solid arrows. The magnetic flux generated at the straight-line portions 71*a* of the coil 71, even if the direction of the magnetic flux changes periodically, enters the fixing belt 61 from the outer peripheral surface side of the fixing belt 61, regardless of the magnetic flux direction, but the magnetic flux does not enter the fixing belt 61 from the inner peripheral surface side of the fixing belt 61. That is, the magnetic flux behaves in substantially the same manner as in the vicinity of the center portion of the fixing belt 61 in the X direction (see FIG. 5).

On the other hand, due to the periodical change of the magnetic flux direction, the magnetic flux generated at the bent portions 71*b* of the coil 71 contains magnetic flux directed toward the outer peripheral surface of the fixing belt 61 and magnetic flux directed toward the inner peripheral surface of the fixing belt 61 via an end surface of the fixing roller 62 in the X direction. The magnetic flux directed from the outer peripheral surface side of the fixing belt 61 toward the outer peripheral surface of the fixing belt 61 directly passes through the outer peripheral surface of the fixing belt 61. In contrast, the magnetic flux directed toward the inner peripheral surface of the fixing belt 61 via the end surface of the fixing roller 62 in the X direction, with the belt regulating plate 64 including the nonmagnetic metal plate 64*b* provided at the end surface side of the fixing roller 62 in the X direction, is blocked by the belt regulating plate 64 (the nonmagnetic metal plate 64*b*) before the magnetic flux reaches the end surface of the fixing roller 62 in the X direction.

Figure 7:
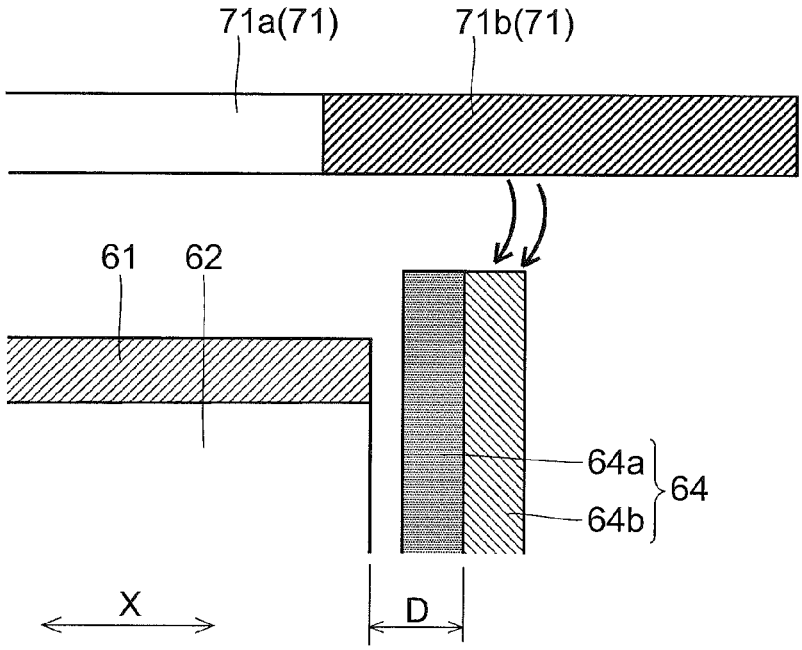
FIG. 7 is a diagram for illustrating a flow of magnetic flux in the vicinity of an edge of the fixing belt of the fixing portion shown in FIG. 2 (magnetic flux and magnetic flux directions are indicated by arrows)
Figure 8:
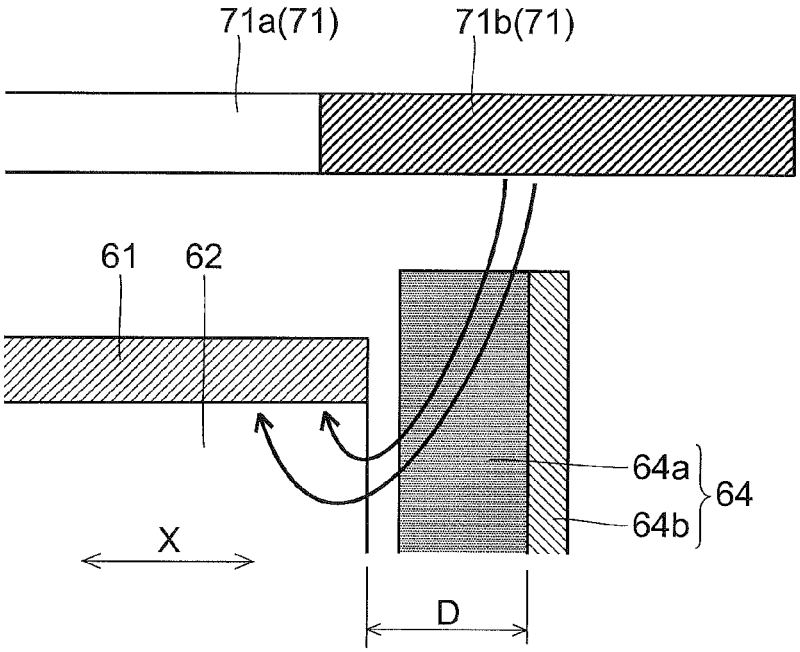
FIG. 8 is a diagram for illustrating a flow of magnetic flux in the vicinity of the edge of the fixing belt of the fixing portion shown in FIG. 2 without the belt regulating plate (nonmagnetic metal layer)

Furthermore, the interval D in the X direction between the edge of the fixing belt 61 and the nonmagnetic metal plate 64*b* is as small as about 5 mm or less (the thickness of the resin plate 64*a* is small), and this reduces, as shown in FIG. 7, the amount of magnetic flux that passes through the area between the edge of the fixing belt 61 and the nonmagnetic metal plate 64*b* (the resin plate 64*a* disposing area) to enter the inner peripheral surface of the fixing belt 61. If the interval D in the X direction between the edge of the fixing belt 61 and the nonmagnetic metal plate 64*b* is increased (if the thickness of the resin plate 64*a* is increased), as shown in FIG. 8, the magnetic flux that has passed through the area between the edge of the fixing belt 61 and the nonmagnetic metal plate 64*b* (the resin plate 64*a* disposing area) enters the inner peripheral surface of the fixing belt 61, and this degrades to some extent the effect of blocking magnetic flux. For this reason, it is preferable to set the interval D in the X direction between the edge of the fixing belt 61 and the nonmagnetic metal plate 64*b* to be about 5 mm or less.

The fixing portion 106 (the fixing device) of the image forming apparatus 100 of the present embodiment is provided with, as described above, the fixing belt 61 that is formed in an endless shape and has the induction heating layer 61*a*, the fixing roller 62 that is inserted inside the fixing belt 61, that is rotatably supported with the shaft extending in the X direction as its rotation shaft, and that is configured to rotate with the fixing belt 61, the pressure roller 63 that is pressed against the fixing belt 61 and configured to rotate to cause the fixing belt 61 and the fixing roller 62 to perform driven-rotation, the coil 71 that is disposed at an interval from the fixing belt 61, at the side opposite from the pressure roller 63 with respect to the fixing belt 61, that is wound in a loop shape elongated in the X direction so as to extend over from one end portion to the other end portion of the fixing belt 61 in the X direction, and that is configured to generate magnetic flux for induction heating by which the fixing belt 61 is heated, and a belt regulating plate 64 that is disposed at the side of the end surface of the fixing roller 62 in the X direction such that the belt regulating plate 64 comes into contact with the fixing belt 61 when the fixing belt 61 moves in the X direction, to thereby regulate movement of the fixing belt 61 in the X direction. Here, the belt regulating plate 64 has a multi-layer structure including the resin plate 64*a* (the resin layer) disposed on the side of the belt regulating plate 64 close to the fixing belt 61 and the nonmagnetic metal plate 64*b* (the nonmagnetic metal layer) disposed on the side of the belt regulating plate 64 away from the fixing belt 61.

According to the present invention, since the portion of the belt regulating plate 64 disposed on the side thereof away from the fixing belt 61 is constituted of the nonmagnetic metal plate 64*b*, magnetic flux directed toward the inner peripheral surface of the fixing belt 61 via the end surface of the fixing roller 62 in the X direction is blocked by the nonmagnetic metal plate 64*b*, and accordingly the amount of magnetic flux entering the fixing belt 61 from the inner peripheral surface side of the fixing belt 61 is reduced. This helps reduce occurrence of a phenomenon in which, in the vicinity of the end portion of the fixing belt 61 in the belt width direction thereof (the X direction), an eddy current generated by magnetic flux that has entered the fixing belt 61 from the outer peripheral surface side of the fixing belt 61 and an eddy current generated by magnetic flux that has entered the fixing belt 61 from the inner peripheral surface side of the fixing belt 61 interfere with each other, so that the two eddy currents cancel each other (less eddy current is converted to heat). To describe this by using a graph (see FIG. 9) showing relationship between position of the fixing belt 61 in the belt width direction thereof (the X direction) and amount of heat generation, in a case where the belt regulating plate 64 including the nonmagnetic metal plate 64*b* is provided at the side of the end surface of the fixing roller 62 in the X direction (see a solid line A in the graph), in comparison with a case where the belt regulating plate 64 including the nonmagnetic metal plate 64*b* is not provided at the side of the end surface of the fixing roller 62 in the X direction (see a broken line B in the graph), reduction of the amount of heat generation at the end portion of the fixing belt 61 in the belt width direction thereof (the X direction) is reduced. Thereby, it is possible to reduce decline of temperature of a portion of the fixing belt 61 in the vicinity of each end portion thereof to lower than temperature of a portion of the fixing belt 61 in the vicinity of the center portion thereof in the belt width direction (the X direction).

Figure 9:
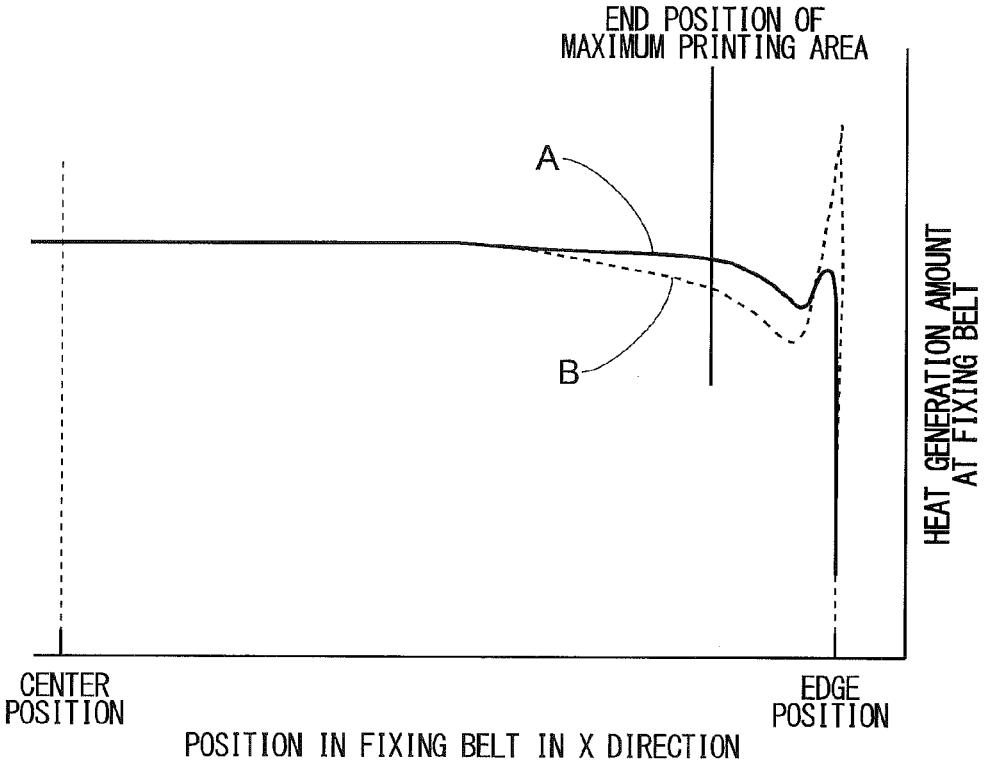
FIG. 9 is a diagram for illustrating advantageous effects of the present invention (a graph indicating relationship between position of the fixing belt in the belt width direction thereof and amount of heat generation)
Figure 10:
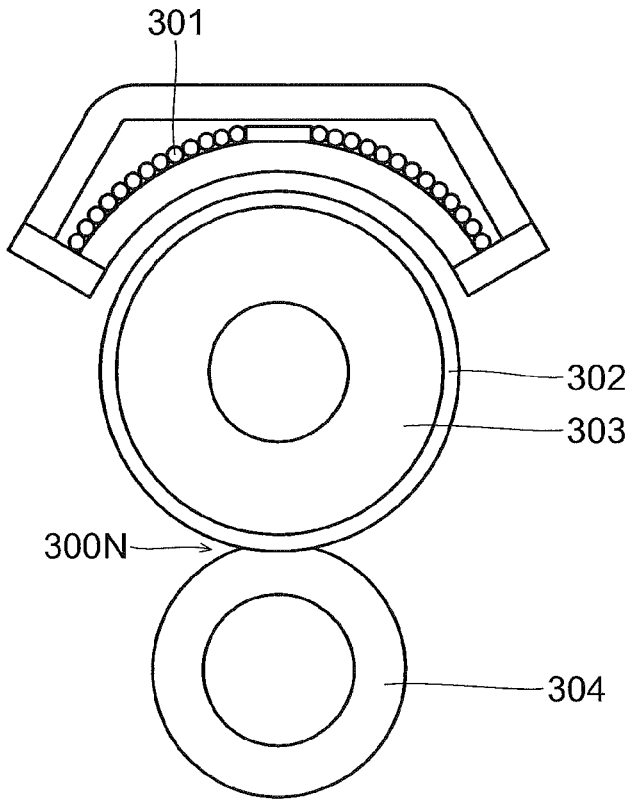
FIG. 10 is a diagram showing an example of conventional fixing devices.
Figure 11:
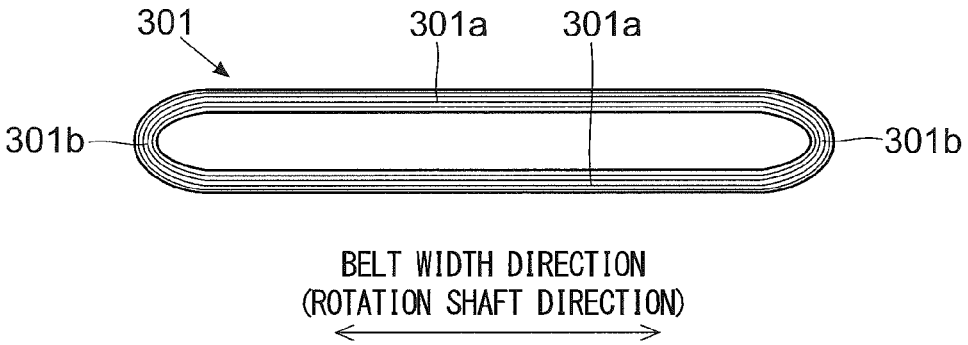
FIG. 11 is a diagram for illustrating a shape of a coil used in the conventional fixing device shown in FIG. 10.
Figure 12:
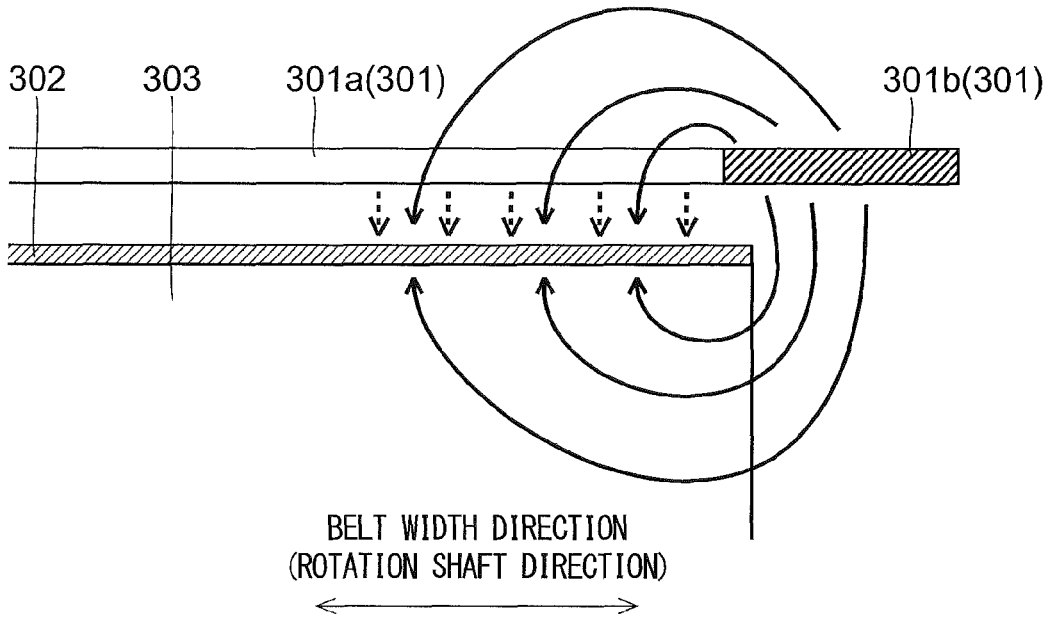
FIG. 12 is a diagram for illustrating a flow of magnetic flux in the vicinity of an end portion of the conventional fixing device shown in FIG. 10 in a belt width direction of a fixing belt (magnetic flux and magnetic flux direction are indicated by arrows).

Furthermore, with the belt regulating plate 64 including the nonmagnetic metal plate 64*b* provided at the side of the end surface of the fixing roller 62 in the X direction, the edge of the fixing belt 61 is in a state shielded by the nonmagnetic metal plate 64*b*, and this helps reduce the concentration of magnetic flux on an edge of the fixing belt 61. Thus, as shown in FIG. 9, in the case where the belt regulating plate 64 including the nonmagnetic metal plate 64*b* is provided at the side of the end surface of the fixing roller 62 in the X direction (see the solid line A in the graph), in comparison with the case where the belt regulating plate 64 including the nonmagnetic metal plate 64*b* is not provided at the side of the end surface of the fixing roller 62 in the X direction (see the broken line B in the graph), it is possible to prevent excessive rise of temperature at the edge of the fixing belt 61 as well.

A belt portion of the fixing belt 61 that passes by the fixing nip 60N (a belt portion that is pressed against the pressure roller 63) yields by being pressed against the pressure roller 63, and then after leaving the fixing nip 60N, the belt portion is released from the state of being pressed against the pressure roller 63, and recovered. That is, the fixing belt 61 rotates while being partially displaced in the diameter direction of the fixing belt 61. Thus, if the fixing belt 61 is displaced in the belt width direction thereof (the X direction) into contact with the belt regulating plate 64, even if the fixing belt 61 rotates together with the belt regulating plate 64, the fixing belt 61 behaves such that it rubs itself against the belt regulating plate 64 in the vicinity of the fixing nip 60N. As a result, stress is applied to the fixing belt 61.

According to the present invention, however, although the portion of the belt regulating plate 64 on the side thereof away from the fixing belt 61 side is constituted of the nonmagnetic metal plate 64*b*, the portion of the belt regulating plate 64 on the side thereof close to the fixing belt 61 is constituted of the resin plate 64*a*. Thus, it is the resin plate 64*a* that the fixing belt 61 comes into contact with when the fixing belt 61 is displaced in the belt width direction thereof (the X direction). Here, if the member that comes into contact with the fixing belt 61 is a metal plate, and if the metal plate is harder than the fixing belt 61, when the fixing belt 61 and such a metal plate rub against each other, it will cause chipping and erosion of the fixing belt 61 to occur. In contrast, if the member that comes into contact with the fixing belt 61 is the resin plate 64*a*, which is soft, chipping and erosion of the fixing belt 61 are less likely to occur. Moreover, since resin as the constituent material of the resin plate 64*a* can be processed with a high degree of freedom, it is possible to give the surface of the resin plate 64*a* a shape and surface smoothness that allow the fixing belt 61 to slide thereon smoothly. Thus, even if the fixing belt 61 behaves such that it rubs itself against the belt regulating plate 64, stress applied to the fixing belt 61 is reduced. This helps reduce deformation and deterioration of the fixing belt 61.

According to the present embodiment, as described above, the thickness of the nonmagnetic metal plate 64*b* in the X direction is set to be about 0.1 mm or more (specifically, about 0.5 mm). Furthermore, the nonmagnetic metal plate 64*b* is formed of aluminum, copper, or nonmagnetic stainless steel. Use of the thus formed nonmagnetic metal plate 64*b* allows satisfactory blockage, with the nonmagnetic metal plate 64*b*, of the magnetic flux directed toward the inner peripheral surface of the fixing belt 61 via the end surface of the fixing roller 62 in the X direction. If the thickness of the nonmagnetic metal plate 64*b* in the X direction is about 0.1 mm or more, it is also possible to reduce heat generation at the nonmagnetic metal plate 64*b*.

According to the present embodiment, as described above, a member obtained by integrating the resin plate 64*a* and the nonmagnetic metal plate 64*b* with each other is used as the belt regulating plate 64. This helps reduce the number of parts. This also facilitates the operation of attaching the belt regulating plate 64.

Here, the resin plate 64*a* and the nonmagnetic metal plate 64*b* may be different members, and in that case, the process of integrating the resin plate 64*a* and the nonmagnetic metal plate 64*b* with each other is not necessary.

It should be understood that the embodiments disclosed herein are merely illustrative in all respects, and should not be interpreted restrictively. The range of the present invention is shown not by the above descriptions of the embodiments but by the scope of claims for patent, and it is intended that all modifications within the meaning and range equivalent to the scope of claims for patent are included.

The invention claimed is:

1. A fixing device, comprising:

a fixing belt that is formed in an endless shape and has an induction heating layer;

a fixing roller that is inserted inside the fixing belt, that is rotatably supported with a shaft extending in a predetermined direction as a rotation shaft, and that is configured to rotate with the fixing belt;

a pressure roller that is pressed against the fixing belt and configured to rotate to thereby cause the fixing belt and the fixing roller to perform driven-rotation;

a coil that is disposed at an interval from the fixing belt, at a side opposite from the pressure roller with respect to the fixing belt, that is wound in a loop shape elongated in the predetermined direction so as to extend over from one end portion to another end portion of the fixing belt in the predetermined direction, and that is configured to generate magnetic flux for induction heating by which the fixing belt is heated; and a belt regulating plate that is disposed at a side of an end surface of the fixing roller in the predetermined direction such that the belt regulating plate comes into contact with the fixing belt when the fixing belt moves in the predetermined direction to thereby regulate movement of the fixing belt in the predetermined direction, wherein the belt regulating plate has a multi-layer structure including a resin layer disposed on a side of the belt regulating plate close to the fixing belt and a nonmagnetic metal layer disposed on a side of the belt regulating plate away from the fixing belt.

2. The fixing device according to claim 1, wherein a thickness of the nonmagnetic metal layer in the predetermined direction is not less than 0.1 mm.

3. The fixing device according to claim 1, wherein a constituent material of the nonmagnetic metal layer is aluminum, copper, or nonmagnetic stainless steel.

4. The fixing device according to claim 1, wherein the resin layer and the nonmagnetic metal layer are integrated with each other.

5. The fixing device according to claim 1, wherein the resin layer and the nonmagnetic metal layer are different members.

6. The fixing device according to claim 1, wherein a thickness of the resin layer in the predetermined direction is set such that an interval in the predetermined direction between an edge of the fixing belt in the predetermined direction and the nonmagnetic metal layer is not greater than 5 mm.

7. An image forming apparatus comprising the fixing device according to claim 1.

* * * * *